US007451602B2

(12) United States Patent
Marakovits et al.

(10) Patent No.: US 7,451,602 B2
(45) Date of Patent: Nov. 18, 2008

(54) METHODS AND APPARATUS FOR INJECTING FLUIDS INTO TURBINE ENGINES

(75) Inventors: Steve Marakovits, Mason, OH (US); Mark Durbin, Springboro, OH (US)

(73) Assignee: General Electric Company, Schenectady, NY (US)

( * ) Notice: Subject to any disclaimer, the term of this patent is extended or adjusted under 35 U.S.C. 154(b) by 551 days.

(21) Appl. No.: 11/268,043

(22) Filed: Nov. 7, 2005

(65) Prior Publication Data

US 2007/0101725 A1 May 10, 2007

(51) Int. Cl.
*F02C 3/30* (2006.01)

(52) U.S. Cl. ..... 60/775; 60/39.58

(58) Field of Classification Search ..... 60/39.53, 60/39.55, 39.58, 39.59, 775; 431/190
See application file for complete search history.

(56) References Cited

U.S. PATENT DOCUMENTS 5,058,374 A * 10/1991 Bechlher et al. ..... 60/39.55
5,720,164 A * 2/1998 Corbett et al. ..... 60/39.53
6,311,471 B1 * 11/2001 Waldherr et al. ..... 60/775
6,370,862 B1 4/2002 Cheng
6,418,724 B1 * 7/2002 Cheng ..... 60/775
6,715,295 B2 4/2004 Gadde et al.
6,865,890 B2 3/2005 Walker
6,935,116 B2 8/2005 Stuttaford et al.
6,938,425 B2 9/2005 Simpson et al.
6,968,698 B2 11/2005 Walsh et al.
6,983,605 B1 1/2006 Hook et al.
7,028,485 B1 4/2006 Mee
7,047,748 B2 5/2006 Zauderer
7,178,339 B2 2/2007 Goldmeer et al.
7,200,997 B2 4/2007 Carlson, Jr. et al.
2007/0101726 A1 * 5/2007 Durbin et al. ..... 60/775

* cited by examiner

*Primary Examiner*—Louis J Casaregola
(74) *Attorney, Agent, or Firm*—William Scott Andes, Esq.; Armstrong Teasdale LLP

(57) ABSTRACT

A method facilitates operating a gas turbine engine. The method comprises supplying steam and primary fuel to a chamber within a nozzle, mixing the primary fuel and steam within the chamber, and discharging the mixture into a combustor from a plurality of circumferentially spaced mixture outlets.

17 Claims, 4 Drawing Sheets

METHODS AND APPARATUS FOR INJECTING FLUIDS INTO TURBINE ENGINES

BACKGROUND OF THE INVENTION

This application relates generally to gas turbine engines and, more particularly, to methods and apparatus for injecting fluids into turbine engines.

Air pollution concerns worldwide have led to stricter emissions standards both domestically and internationally. These same standards have caused turbine engine manufacturers to design more efficient engines, as well as design improved retrofit components that enable engines to operate more efficiently, with improved emissions, and/or with extended useful life and reliability. Moreover, the generally high capital costs associated with the purchase and maintenance of turbine engines, such as revenue losses generated during engine outages, have caused the same engine manufacturers to attempt to design engines that are more reliable and that have extended useful life.

Controlling the mixture of fluids, i.e. gas and steam, delivered to a gas turbine engine may be critical to the engine's performance. Typically, gas turbine engines operating with gas and steam do not meet emissions requirements at all operating conditions, and in particular, such engines generally do not satisfy carbon monoxide (CO) emission requirements as well as other known engines. For example, at least some known gas turbine engines utilizing gas and steam generate higher CO emissions than gas turbine engines utilizing gas and water. More specifically poor mixing of the gas and steam may cause fuel to remain inboard, leading to higher CO emissions being generated. Moreover, poor mixing may cause the recirculation stability zone within the combustor to be shifted downstream, which may cause the flame to become detached, resulting in the generation of CO emissions.

BRIEF DESCRIPTION OF THE INVENTION

In one aspect, a method of operating a gas turbine engine is provided. The method comprises supplying primary fuel to a chamber within a nozzle, supplying steam to the chamber, and mixing the primary fuel and steam in the chamber prior to discharging the mixture into the combustor from at least one outlet spaced circumferentially around, and extending outward from, a centerline extending through the nozzle.

In another aspect, a nozzle tip for a turbine engine fuel nozzle is provided. The tip includes an annular body including two chambers, at least one pilot fuel outlet, and at least one fuel mixture outlet. The at least one pilot fuel outlet is configured to discharge pilot fuel from one of the two chambers within the fuel nozzle tip. The at least one fuel mixture outlet is configured to discharge a mixture of primary fuel and steam from the second chamber of the fuel nozzle tip. The second chamber is configured to pre-mix the primary fuel and steam prior to discharging the mixture from the fuel nozzle tip.

In a further aspect, a gas turbine engine is provided. The gas turbine engine includes a combustor and a fuel nozzle including a fuel nozzle tip. The fuel nozzle tip includes an annular body including two chambers, at least one pilot fuel outlet, and at least one fuel mixture outlet. The at least one pilot fuel outlet is configured to discharge pilot fuel to the combustor only during pre-selected engine operations. The at least one fuel outlet is configured to release a mixture of primary fuel and steam into the combustor when more power is demanded by the gas turbine engine.

DETAILED DESCRIPTION OF THE INVENTION

Figure 1:
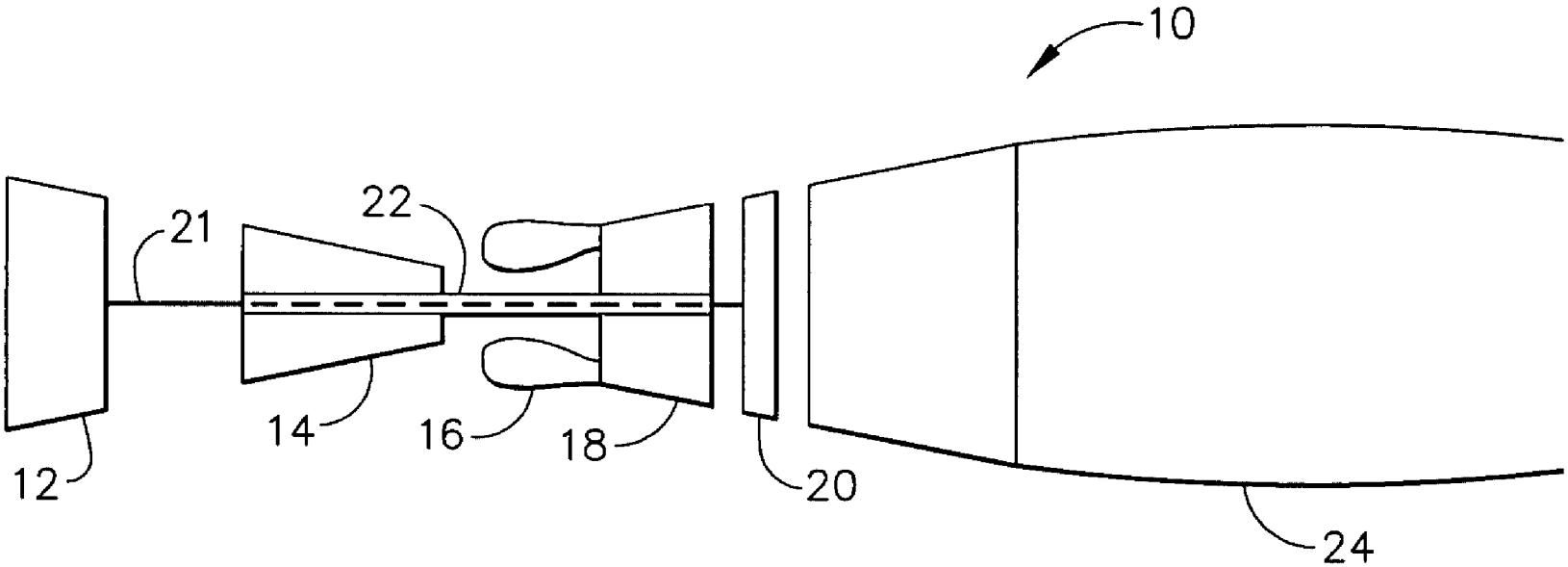
FIG. 1 is a schematic illustration of an exemplary gas turbine engine.

FIG. 1 is a schematic illustration of an exemplary gas turbine engine 10 including a low pressure compressor 12, a high pressure compressor 14, and a combustor 16. Engine 10 also includes a high pressure turbine 18 and a low pressure turbine 20. Compressor 12 and turbine 20 are coupled by a first shaft 22, and compressor 14 and turbine 18 are coupled by a second shaft 21. In one embodiment, gas turbine engine 10 is an LM2500 engine commercially available from General Electric Aircraft Engines, Cincinnati, Ohio.

In operation, air flows through low pressure compressor 12 supplying compressed air from low pressure compressor 12 to high pressure compressor 14. The highly compressed air is delivered to combustor 16. Airflow from combustor 16 is channeled through a turbine nozzle to drive turbines 18 and 20, prior to exiting gas turbine engine 10 through an exhaust nozzle 24. As is known in the art, gas turbine engines further include fuel nozzles (not shown) which supply fuel to the combustor 16.

Figure 2:
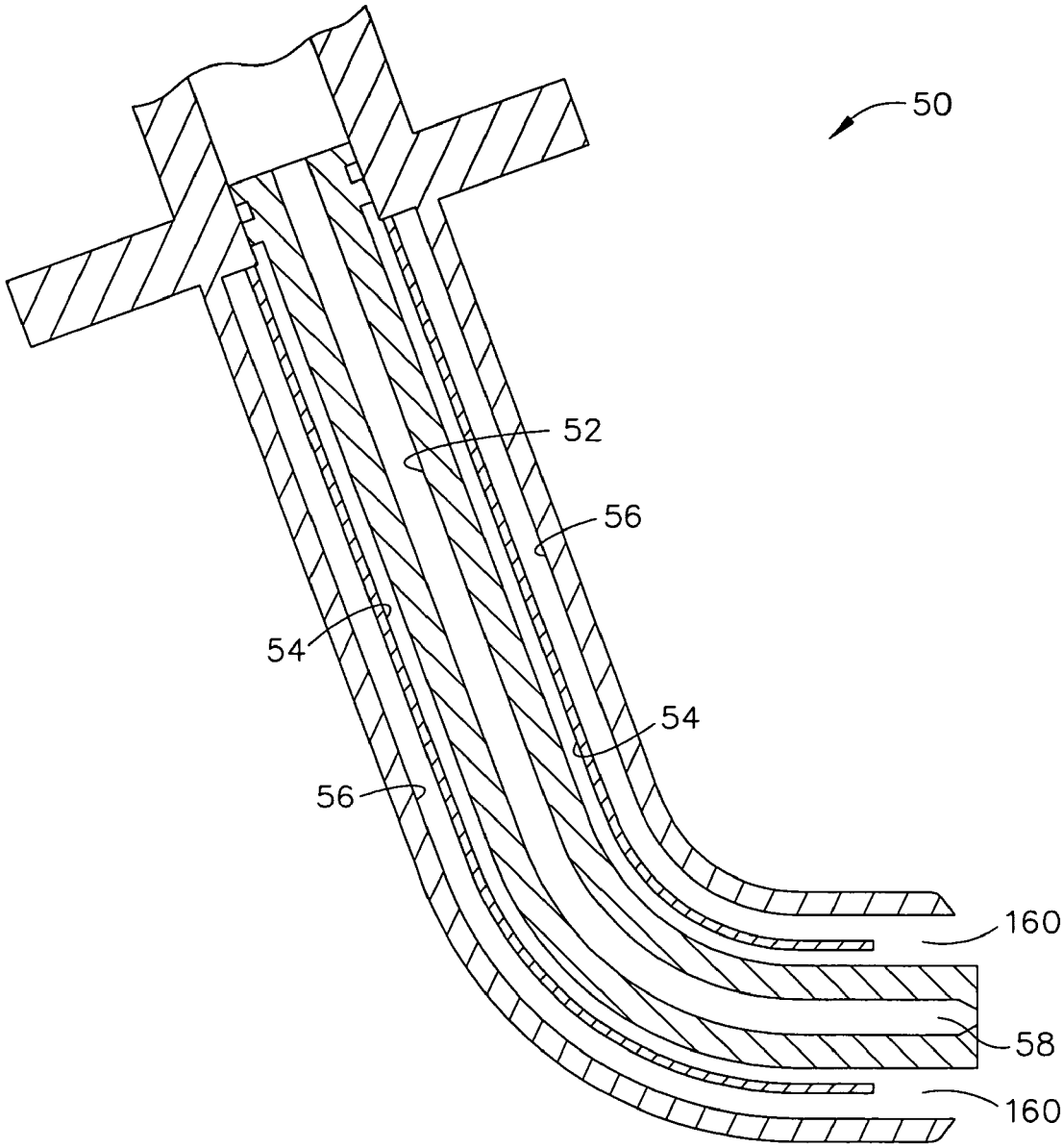
FIG. 2 is a cross-sectional view of an exemplary embodiment of a fuel nozzle that may be used with the gas turbine engine shown in FIG. 1.

FIG. 2 is a side schematic cross-sectional view of an exemplary embodiment of a fuel nozzle 50 that may be used with a gas turbine engine such as gas turbine engine 10 (shown in FIG. 1). Fuel nozzle 50 includes a pilot fuel circuit 52, a primary fuel circuit 54, and a steam circuit 56. Pilot fuel circuit 52 delivers pilot fuel through the center of nozzle 50 to the end 58 of nozzle 50 during start-up and idle operations. End 58 is configured to discharge pilot fuel into the combustor 16 (shown in FIG. 1) of gas turbine engine 10. Primary fuel circuit 54 and steam circuit 56 are positioned radially outward from, and circumferentially around, pilot fuel circuit 52. Primary fuel circuit 54 and steam circuit 56 deliver primary fuel and steam, respectively, to combustor 16 through nozzle end 58. More specifically, primary fuel and steam are each discharged through nozzle end 58 into a combustion zone defined downstream from nozzle 50 within combustor 16.

Figure 3:
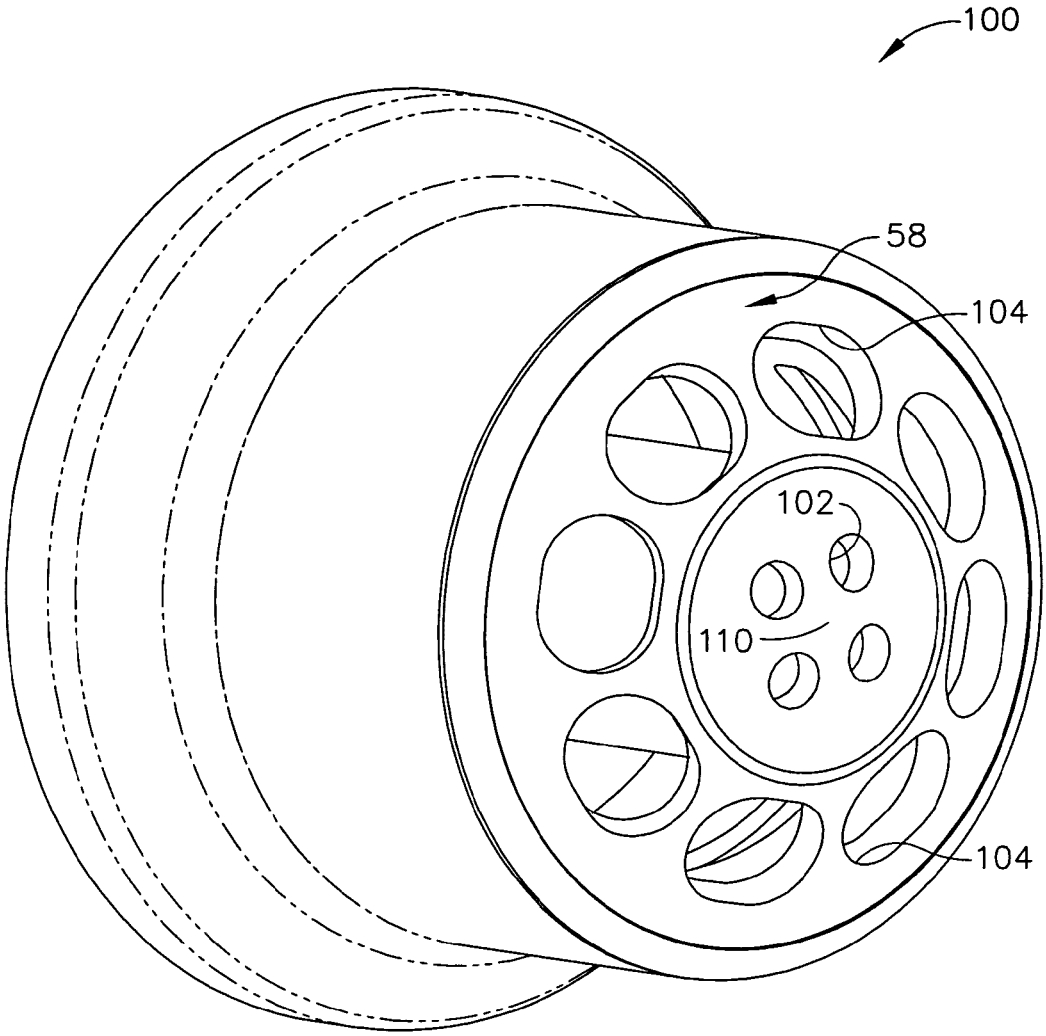
FIG. 3 is a perspective of an exemplary fuel nozzle tip that may be used with the fuel nozzle shown in FIG. 2.
Figure 4:
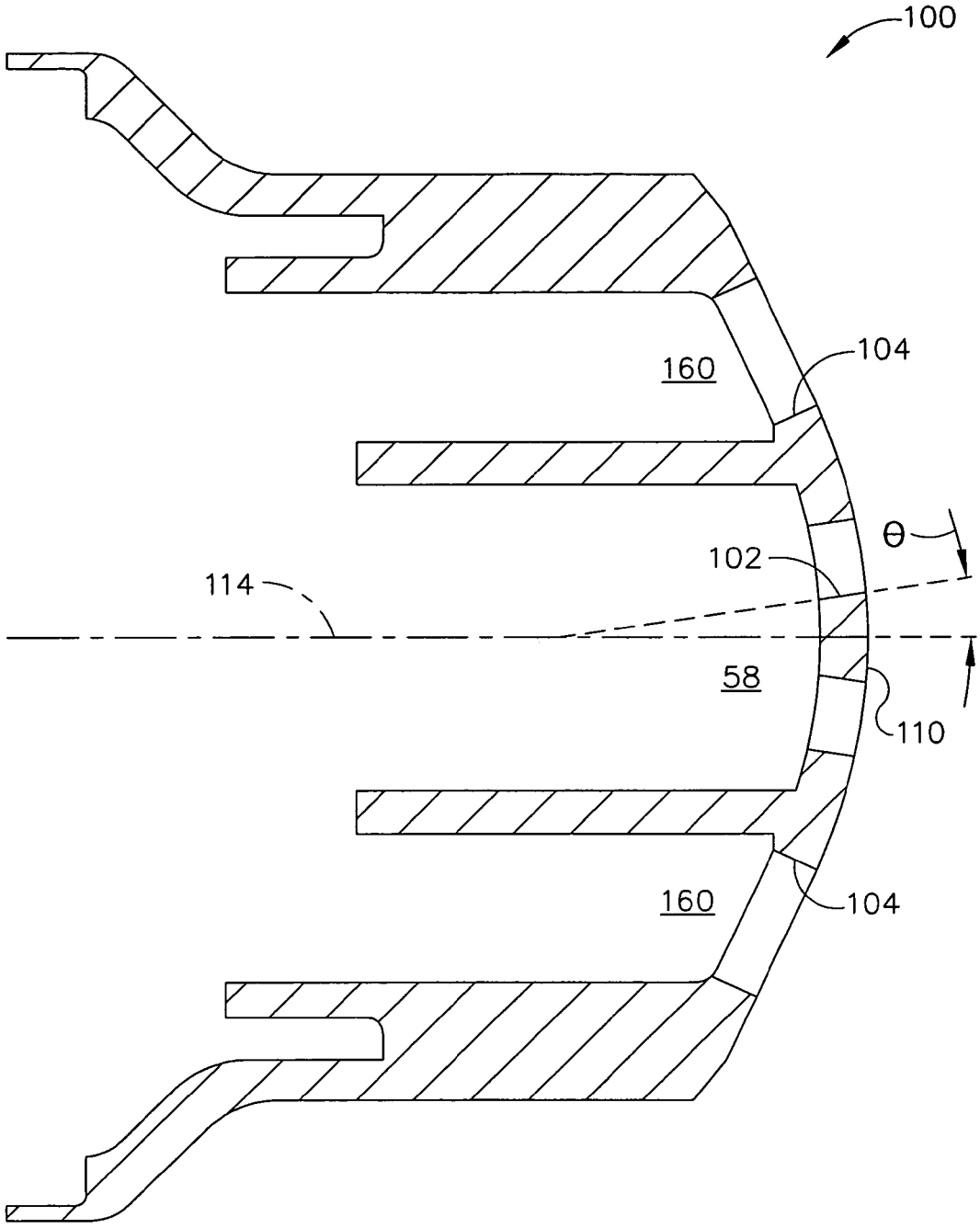
FIG. 4 is a cross-sectional view of the fuel nozzle tip shown in FIG. 3.

FIG. 3 is a perspective view of an exemplary fuel nozzle tip 100 that may be used with a gas turbine engine, such as turbine engine 10 (shown in FIG. 1). FIG. 4 is a cross-sectional view of nozzle tip 100. Nozzle tip 100 includes a plurality of pilot fuel outlets 102 and a plurality of fuel mixture outlets 104. Pilot fuel outlets 102 are spaced circumferentially about, and radially outward from, a center 110 of fuel nozzle tip 100.

In the exemplary embodiment, pilot fuel outlets 102 are oriented obliquely with respect to centerline 114 extending through nozzle tip 100. As such, pilot fuel discharged from outlets 102 is expelled outward from tip 100 at an oblique angle θ away from centerline 114 and toward fuel mixture being discharged from fuel mixture outlets 104. In the exemplary embodiment, nozzle tip 100 includes four pilot fuel outlets 102. In alternative embodiments, nozzle tip 100 includes more or less then four pilot fuel outlets 102. As will be appreciated by one of ordinary skill in the art, the number of pilot fuel outlets 102 varies depending on the application of fuel nozzle tip 100.

Fuel mixture outlets 104 are spaced circumferentially around, and radially outward from, pilot fuel outlets 102. Furthermore, fuel mixture outlets 104 are configured to discharge a fuel/steam mixture from a chamber 160 (shown in FIG. 2) defined within fuel nozzle tip 100. In the exemplary embodiment, fuel mixture outlets 104 are oriented substantially parallel to centerline 114. In an alternative embodiment, fuel mixture outlets are oriented obliquely with respect to centerline 114. As such, fuel mixture discharged from fuel mixture outlets 104 is expelled outward from tip 100 substantially parallel to centerline 114.

During operation pilot outlets 102 discharge pilot fuel into the combustor during start up or idle operations of the gas turbine engine. When additional power is demanded, primary fuel and steam are mixed within chamber 160 and discharged through fuel mixture outlet 104 into a combustion zone defined in the combustor of a gas turbine engine. Because primary fuel and steam are mixed prior to being discharged into the combustion zone, the lean mixture provides lower emissions than a non-premixed nozzle tip. Accordingly, the enhanced mixing of primary fuel and steam within nozzle tip 100 facilitates maintaining a more stable flame within the combustion zone defined in the combustor. Generally, controlling the stability of the flame facilitates reducing generation of CO emissions within the combustor.

As used herein, an element or step recited in the singular and proceeded with the word "a" or "an" should be understood as not excluding plural said elements or steps, unless such exclusion is explicitly recited. Furthermore, references to "one embodiment" of the present invention are not intended to be interpreted as excluding the existence of additional embodiments that also incorporate the recited features.

The above described fuel nozzle tip for a gas turbine engine provides an engine capable of meeting emissions standards. The fuel nozzle tip includes a chamber wherein the primary fuel and steam can be premixed before being discharged into the combustor. As a result, a more stable flame is maintained with the combustion zone defined with the combustor, which facilitates reducing the generation of CO emissions.

Although the methods and systems described herein are described in the context of supplying fuel to a gas turbine engine, it is understood that the fuel nozzle tip methods and systems described herein are not limited to gas turbine engines. Likewise, the fuel nozzle tip components illustrated are not limited to the specific embodiments described herein, but rather, components of the fuel nozzle tip can be utilized independently and separately from other components described herein.

While the invention has been described in terms of various specific embodiments, those skilled in the art will recognize that the invention can be practiced with modification within the spirit and scope of the claims.

What is claimed is:

1. A method of operating a gas turbine engine wherein the nozzle includes a first chamber and a second chamber defined separately therein, said method comprising:

supplying pilot fuel to the first chamber during preselected engine operations;

supplying primary fuel and steam to the second chamber during other preselected engine operations to facilitate mixing of the primary fuel and the steam;

mixing the primary fuel and the steam within a tip of the nozzle; and discharging the mixture of primary fuel and steam from the nozzle tip through a plurality of mixture outlets defined in the nozzle tip.

2. A method in accordance with claim 1 wherein the nozzle tip is substantially circular and includes a centerline extending through the nozzle, wherein said discharging the mixture of primary fuel and steam from the nozzle further comprises discharging the mixture from the nozzle through a plurality of mixture outlets defined at a first radial distance outward from the centerline.

3. A method in accordance with claim 2 further comprising discharging pilot fuel through a plurality of pilot fuel outlets defined at a second radial distance outward from the centerline.

4. A method in accordance with claim 1 further comprising discharging pilot fuel through a plurality of pilot fuel outlets defined in the nozzle tip and radially inward from the plurality of mixture outlets.

5. A method in accordance with claim 1 further comprising discharging the mixture of primary fuel and steam at a discharge angle that is substantially parallel to a centerline extending through the nozzle tip.

6. A method in accordance with claim 1 further comprising discharging the pilot fuel at an oblique angle from the nozzle tip with respect to a centerline extending through the nozzle tip.

7. A nozzle tip for a turbine engine fuel nozzle, said nozzle tip is substantially circular and includes a centerline extending therethrough, said tip comprising:

an annular body comprising:

a first chamber in flow communication with a pilot fuel source for discharging pilot fuel only during preselected engine operations; and a second chamber in flow communication with a primary fuel source and a steam source for discharging a mixture of primary fuel and steam during other preselected engine operations wherein said primary fuel and steam mixture is configured to be discharged from said second chamber through a plurality of mixture outlets defined at a first radial distance outward from said centerline.

8. A nozzle tip in accordance with claim 7 wherein said first and second chamber are separate such that pilot fuel in said first chamber does not mix with primary fuel and steam in said second chamber.

9. A nozzle tip in accordance with claim 7 wherein pilot fuel is configured to be discharged from said first chamber through a plurality of pilot fuel outlets defined at a second radial distance outward from said centerline.

10. A nozzle tip in accordance with claim 9 wherein said first radial distance is longer then said second radial distance.

11. A nozzle tip in accordance with claim 7 wherein said plurality of mixture outlets are configured to discharge primary fuel and steam mixture from said nozzle tip at an oblique angle with respect to said centerline.

12. A nozzle tip in accordance with claim 7 wherein said nozzle tip is configured to discharge pilot fuel at an oblique angle with respect to said centerline.

13. A gas turbine engine comprising:

a combustor; and a nozzle tip in flow communication with said combustor, said fuel nozzle tip is substantially circular and includes a centerline extending therethrough, said fuel nozzle tip further comprising:

an annular body comprising:

a first chamber in flow communication with a pilot fuel source for discharging pilot fuel into said combustor only during preselected engine operations; and a second chamber in flow communication with a primary fuel source and a steam source for discharging a mixture of primary fuel and steam into said combustor during other preselected engine operations, the primary fuel and steam mixture is configured to be discharged from said second chamber through a plurality of mixture outlets defined at a first radial distance outward from said centerline.

14. A gas turbine engine in accordance with claim 13 wherein said first and second chamber are separate such that pilot fuel in said first chamber does not mix with primary fuel and steam in said second chamber.

15. A gas turbine engine in accordance with claim 13 wherein pilot fuel is configured to be discharged from said first chamber through a plurality of pilot fuel outlets defined at a second radial distance outward from said centerline.

16. A gas turbine engine in accordance with claim 15 wherein said first radial distance is longer then said second radial distance.

17. A gas turbine engine in accordance with claim 7 wherein said nozzle tip is configured to discharge pilot fuel and fuel/steam mixture at an oblique angle with respect to said centerline.

* * * * *